United States Patent [19]

Neuhaus et al.

[11] 4,304,448

[45] Dec. 8, 1981

[54] WASTE BIN

[75] Inventors: Josef Neuhaus; Heinz Langesberg, both of Arnsberg, Fed. Rep. of Germany

[73] Assignee: M. Westermann & Co. GmbH, Arnsberg, Fed. Rep. of Germany

[21] Appl. No.: 140,050

[22] Filed: Apr. 14, 1980

[30] Foreign Application Priority Data

Apr. 21, 1979 [DE] Fed. Rep. of Germany ..... 2916183

[51] Int. Cl.[3] ..... A47B 77/18; B65B 67/04; B65D 43/16

[52] U.S. Cl. ..... 312/273; 312/211; 248/134; 248/147

[58] Field of Search ..... 312/273, 211; 248/95, 248/134, 147

[56] References Cited

U.S. PATENT DOCUMENTS

| | | | |
|---|---|---|---|
| 512,261 | 1/1894 | Nailor | 248/134 |
| 957,237 | 5/1910 | Moorman | 248/134 |
| 1,799,764 | 4/1931 | Schellberg | 248/134 |
| 2,444,125 | 6/1948 | Wheeler | 248/134 |
| 2,621,099 | 12/1952 | Lehman | 312/273 |
| 2,701,112 | 2/1955 | Powers | 248/134 |
| 2,808,173 | 10/1957 | Patnode | 248/147 |
| 3,788,720 | 1/1974 | Schneider | 312/211 |

FOREIGN PATENT DOCUMENTS

| | | | |
|---|---|---|---|
| 1024010 | 5/1956 | Fed. Rep. of Germany | 312/211 |
| 2637074 | 3/1977 | Fed. Rep. of Germany | 312/211 |

OTHER PUBLICATIONS

7319091 West German Gebrauchsmuster.
7035724 West German Gebrauchsmuster.
6906111 West German Gebrauchsmuster.

*Primary Examiner*—Victor N. Sakran
*Attorney, Agent, or Firm*—Martin A. Farber

[57] ABSTRACT

A waste bin for incorporation in a cabinet with a hinged door having a pivot pin extending vertically, laterally of the bin, the pivot pin being operatively mounted on brackets on the other side of the cabinet. A lid is hinged on a hinge pin operatively mounted on the side of the cabinet and opens automatically upon opening of the door, and is pivoted into its open position upon outward pivoting of the bin on the pivot pin when the door is opened, by means of a cam which engages the edge of the lid.

8 Claims, 7 Drawing Figures

WASTE BIN

The invention relates to a waste bin serving for installation in a cabinet equipped with a hinged door capable of being swung open, the waste bin having a pivot pin extending vertically, laterally to the surface of the bin and which pivot pin is mounted on holding brackets on the side of the housing, coupling means for connection of the bin to the door, and a hinged lid opening automatically during opening of the door.

A construction of this kind is known from West German Gebrauchsmuster No. 73 19 091. Upon outward pivoting of the bin from the cabinet body, the lid, which is hinged to the edge of the bin, is held back by a cord attached on the one hand to it and on the other hand in the cabinet body, and thus is pivoted upwards. This arrangement is disadvantageous in as much as by opening the door fast, the lid pivots beyond its normal open position. It must be transferred back again into its functionally correct position in a cumbersome manner. One mostly tries to prevent this defect by opening the door more carefully and moreover the open position of the hinged lid may be designed to be at a lesser angle. The latter solution however obstructs removal of the inner bin, which must for this purpose be tiled forwards. In case of overfilling, it can happen that refuse falls out when this is done.

West German Gebrauchsmuster No. 70 35 724, describes a construction in which the lid of the waste bin is arranged in rocker-like fashion in the vicinity of the front edge of the top of the cabinet body. The waste bin itself is seated on a flap which is hinged to the front edge of the bottom. This solution is not only structurally expensive, but also is disadvantageous for maintenance, as the flap and an additionally provided supporting frame make free access to the interior of the body difficult. A further disadvantage to be seen is that the lid, taking into consideration the tilting movement courses, cannot be coordinated in an odor-sealing manner to the desired extent.

Finally a further construction is known (German Gebrauchsmuster No. 69 06 111) in which the waste bin, which can however be moved out guided on rails, coacts with a lid disposed inside the cabinet body near its top. This lid hangs, free from connection in the height direction, on a carrying portal emerging from the guide rails. Laterally extending lugs provided in the area of the front edge of the lid, which lid is suspended by its four corners, move over lateral control strips of the waste bin. The latter have end-sided lead-in ramps which effect an initial lifting of the lid so that it rises momentarily during inward movement of the waste bin, and then can descend into the closing position. This arrangement not only requires an extremely costly manufacturing process, and is noisy, but to a greatest extent is unfavorable for maintenance, as it requires almost complete dismounting in order to clean the inside of the cabinet.

An object of the present invention in particular, i.e., additionally to that provided from the specification and claims, is to construct a waste bin of the inroductory mentioned type, which with respect to the opening-dependent hinged lid control is simpler to produce, and more favorable with respect to use and service, such that, while retaining a hinged cover and eliminating a tilting position of the waste bin, the complete cross-section for removal for the inner bin is available without being confined.

In accordance with the present invention a pivot cam (N) is provided immediately adjacent the stationary pivot pin (18) of the hinged lid, the pivot pin extending parallel to the bracket stop surface (cabinet wall 7' on the hinge side), which pivot cam, upon outward pivoting of the waste bin (1) during opening of the door (9), runs under the edge of the lid.

As a result of such execution a waste bin coordination is realized which is simple to produce, favorable in use and particularly also advantageous with respect to cleaning.

The hinged lid which is articulated inside the cabinet is controlled by the pivot cam acting in dependency upon the opening pivot movement of the door. The pivot cam is located immediately adjacent to the hinge pin for the hinged lid, which hinge pin extends parallel to the interior housing wall or the bracket abutment surface. By this means, the outwardly pivoted waste bin is practically completely exposed or free with respect to its cross-section for removal. The inner bin may thus be removed or inserted without tilting. Since the lid no longer has to be moved into a tilted position approaching the vertical position (a tilt angle of about 20 degrees is sufficient), with the use of a pregiven cabinet height, the liter capacity can be increased or an intermediate shelf inserted, whereby the usefulness of such an article of furniture is increased.

An advantageous formation further is that one edge strip of the hinged lid, the edge strip overlapping the opening edge of the bin continues up into the range of the hinge pin of the hinged lid, and the pivot cam steps out of its position behind the edge strip over into the position under the edge strip. Here in a favorable manner the corner zone of the lid is used as an insertion space for the pivot cam. The extended edge strip defining this space thereby forms the control edge. The initial section of the cam, which is to be designed as a lead-in ramp can be constructed so that the door is pulled into its closed end position by the weight of the lid. A structurally favorable arrangement resides in the measure of seating the hinge pin of the hinged lid pin on the holding bracket. This component which receives and mounts the vertical pivot pin of the refuse bin, the pivot cam and the hinged lid are moreover designed symmetrically, so that these parts can be used both for a door which closes to the right, as well as for one which closes to the left. This means that the bearing section for the pivot pin on the holding bracket is provided in duplicate. With regard to the arrangement of the hinged lid, the construction is such that a corresponding edge strip is also provided on the opposite side of the hinged lid. The cam itself is simply formed by an upwardly projecting curved rib which is seated on the upper side of an arm projecting on the surface of the refuse bin. An additional arm is also located in the vicinity of the bottom of the refuse bin.

Finally, with respect to the pivot cam still an advantageous feature is that the control surface of the rib slopes downwardly towards the pivot pin of the waste bin, approximately shaped such that each phase of the opening angle of the hinged lid during opening, has an optimum rib abutment surface.

With the above and other objects and advantages in view, the present invention will become more clearly understood in connection with the detailed description of a preferred embodiment, when considered with the accompanying drawings, of which:

Figure 1:
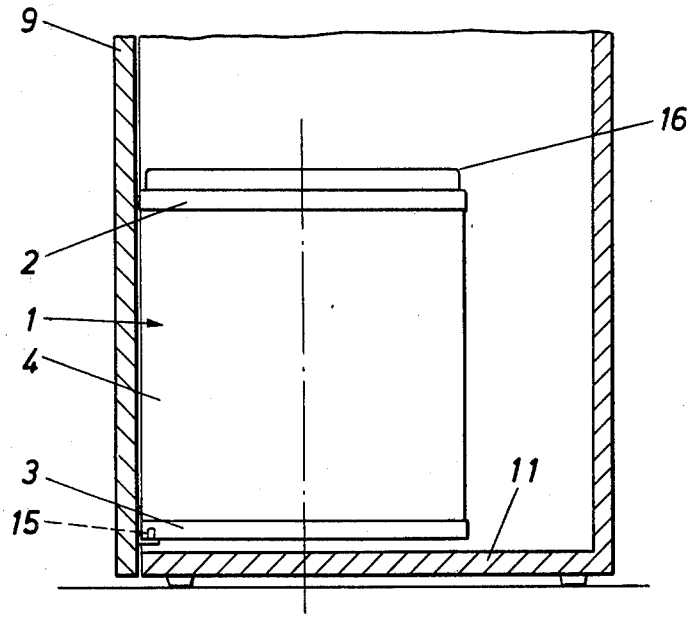
FIG. 1 shows in partial section a cabinet with the waste bin according to the invention with the door closed.

The cylindrically shaped waste bin 1 forming a holder for the refuse vessel terminates with profile rings 2 and 3 respectively at the top and bottom. These rings extend respectively into arms 5 projecting substantially beyond the bin surface 4. A vertically arranged bearing axle or pivot pin 6 which projects upwardly and downwardly beyond the rings 2 and 3 extends through these arms.

The pivot pin 6 is mounted in a cabinet 7 near the hinges 8 of the cabinet door 9.

The bottom end of the pivot pin 6 is seated in a bearing bushing 10. The bearing bushing 10 is mounted on the bottom 11 of the cabinet 7. The arm 5 is supported on the upper face edge of the bearing bushing.

The lid-side or top end of the pivot pin 6 is mounted in an angularly shaped holding bracket 12. The bracket has a vertical angle arm 12' screwed to the cabinet wall 7' which is on the hinge side. The horizontal angle arm 12'' bent inwardly of the cabinet extends into two bearing eyes or lugs 13. The lid-side or top end of the pivot pin 6 is inserted into one of these bearing eyes or lugs, that is into the one closer to the door 9.

Figure 2:
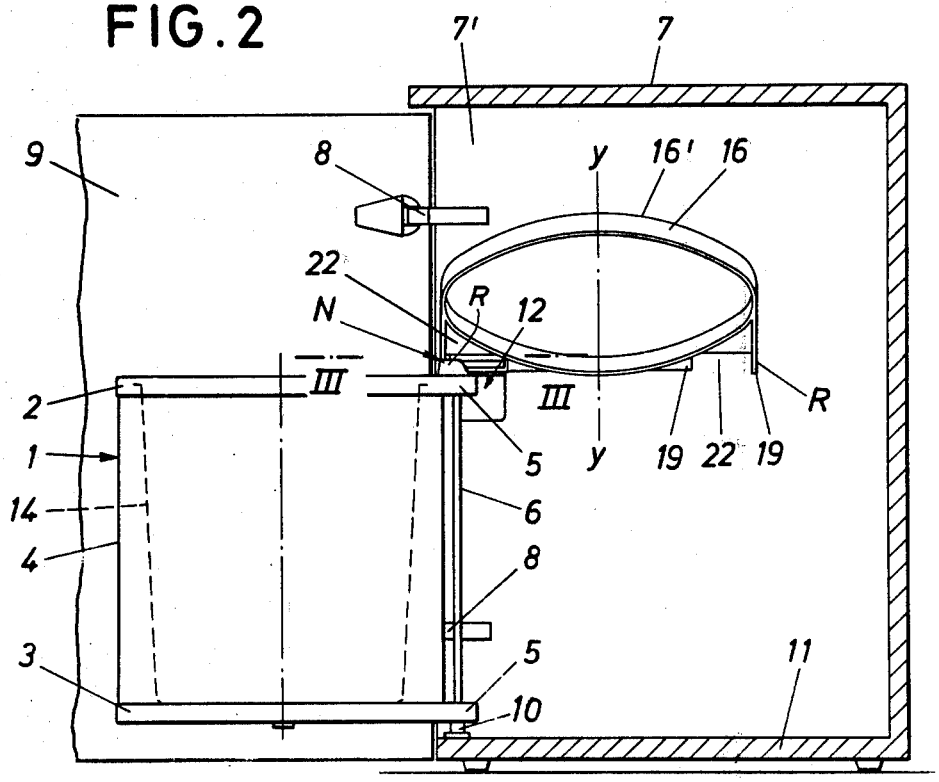
FIG. 2 shows a corresponding yet full sectional view with the door opened.
Figure 4:
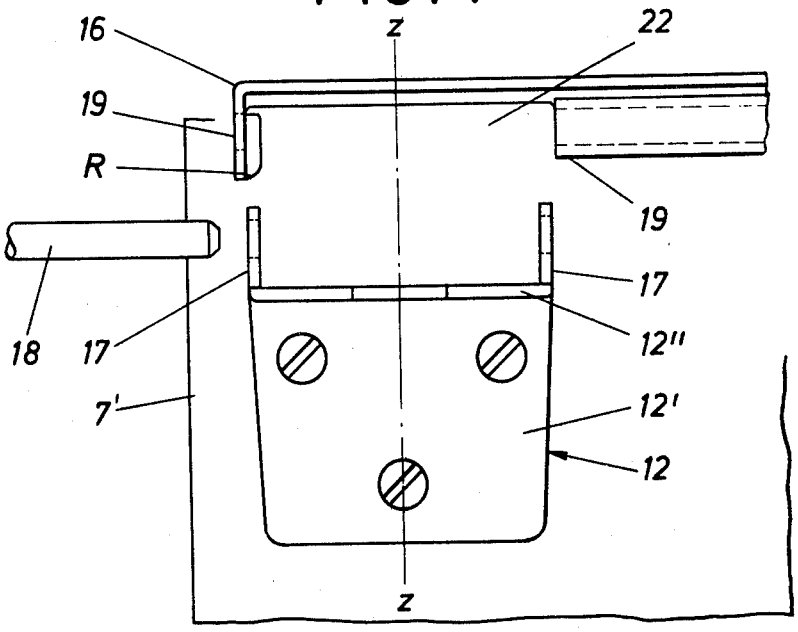
FIG. 4 shows a view of the holding bracket forming the lid hinge point, in the assembling stage.

The waste bin 1 which is hinged in the immediate vicinity of the door can be moved out of the concealed position shown in FIG. 1 into the forwardly pivoted position of FIG. 2 which allows free access for insertion or removal of an inner refuse bin 14. This position is reached in dependency on the movement of the door 9. For this purpose the bin 1 is anchored to the door 9, and namely by a driver pin 15 which engages behind the bottom profiled ring 3. The latter is seated on an angle block which at the same time forms a support for the refuse bin 1.

The inner bin 14, which hangs into an annular shoulder of the top profiled ring 2, together with the waste bin as an entity are closed by a hinged lid 16 which automatically opens upon opening of the door 9. The hinged lid 16 is also hinged to the holding bracket 12 inside the cabinet. For this purpose the holding bracket 12 forms additional, upwardly directed bearing lugs 17. The latter are spaced apart and offset relative to the bearing lugs 13 for the pivot pin 6 of the waste bin in the direction of the cabinet wall 7' on the hinge side. The lid hinge pin 18 passes through the bearing lugs 17 and also through the bearing lugs 19 of the hinged lid 16. These bearing lugs 19 extend outside or exterior to the edge 16' of the hinged lid, which edge 16' overlaps the edge of the opening of the refuse bin 14.

The control of opening of the hinged lid 16 is carried out by a pivot cam N which extends immediately adjacent to the stationary hinge pin 18 of the hinged lid, the hinge pin extending parallel to the bracket surface. Upon opening of the door 9 and the following outward pivoting of the waste bin 1 brought about thereby, the pivot cam N passes beneath the edge 16' of the lid and lifts the hinged lid 16 into the open position according to FIG. 2, the lid swinging about the horizontal pin 18. This pivot cam N, in the form of a rib 20, is located on the upper side of the arm 5 of the upper profiled ring 2, the arm 5 projecting laterally beyond the surface 4 of the refuse bin. The rib may be formed directly on or integrally in one piece with the arm 5. It extends arcuately in front of the bearing lug 13 which lies above or covers the arm 5 there. The center of radius of this arcuate rib is marked P and lies on the other side of the vertical pivot pin 6. The rib 20 extends from one side edge S1 to the other side edge S2 of the arm 5 which has an approximately right-angled shape. Both end sections of the rib 20 have a ramp or lead-in bevel 21. In the embodiment example the lead-in ramp 21 which faces towards the side S1 coacts with the edge strip R of the hinged lid 16, the edge strip R being drawn forward in the vicinity of the hinge pin 18 of the hinged lid. If the door 9 is used as a door closing to the left instead of to the right, the lead-in ramp 21 facing towards the side edge S2 coacts with the edge strip R. To enable use with left or right handed doors both the holding bracket 12 and the lid 16 are correlated to this possibility, in that they are formed symmetrically about or completely identically on both sides of the respective symmetry axes z—z (bracket 12) and y—y (lid 16). In the case of the pivot cam N, the axis of symmetry is denoted x—x. Starting from the corner of the arm 5, it is directed towards the center of the bin.

Figure 7:
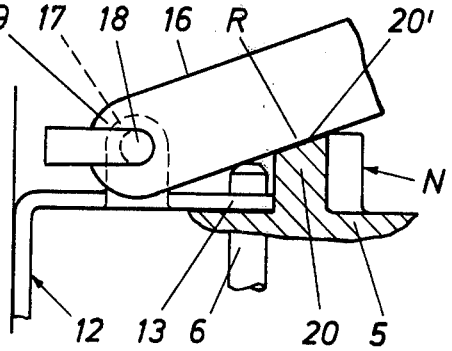
FIG. 7 shows a cross-section through the pivot cam, illustrating the inclination of the control surfaces.

The control surface 20' of the rib 20 slopes downwardly towards the bearing pin 6 of the waste bin, so that at each phase of outward pivoting, the maximum possible contact area is available for the edge strip of the hinged lid, which edge strip travels over it (compare FIG. 7).

Figure 3:
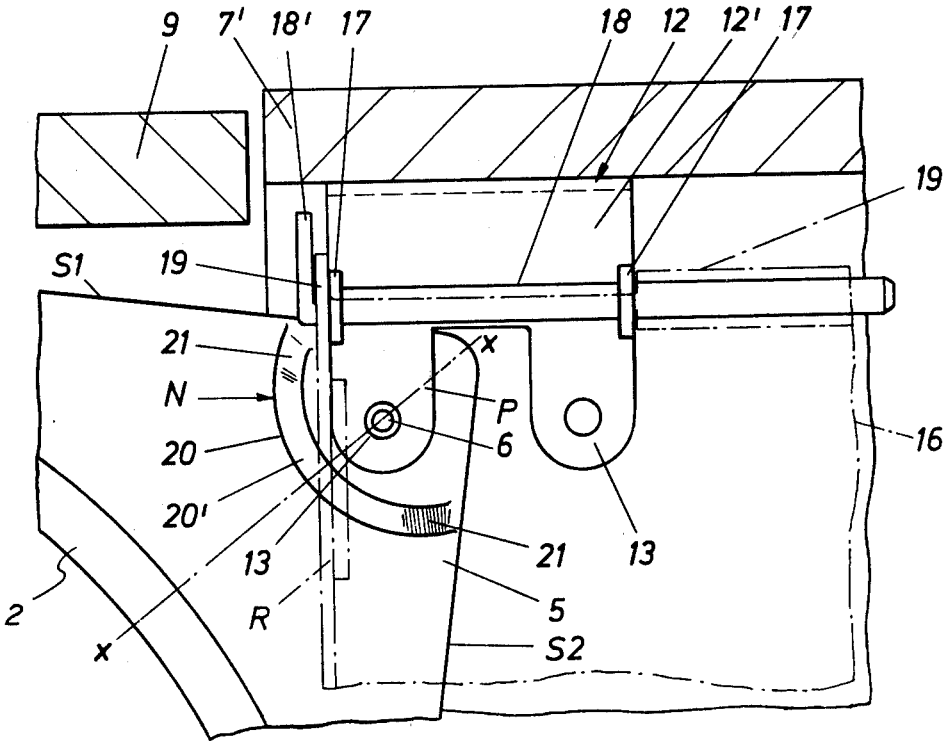
FIG. 3 shows a section along line III—III in FIG. 2, approximately in full size.
Figure 6:
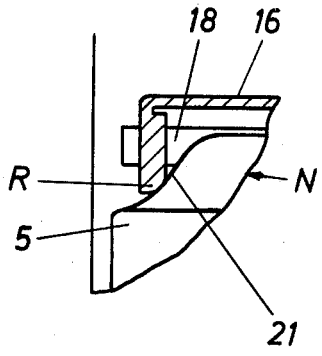
FIG. 6 shows a section along line VI—VI in FIG. 5.
Figure 5:
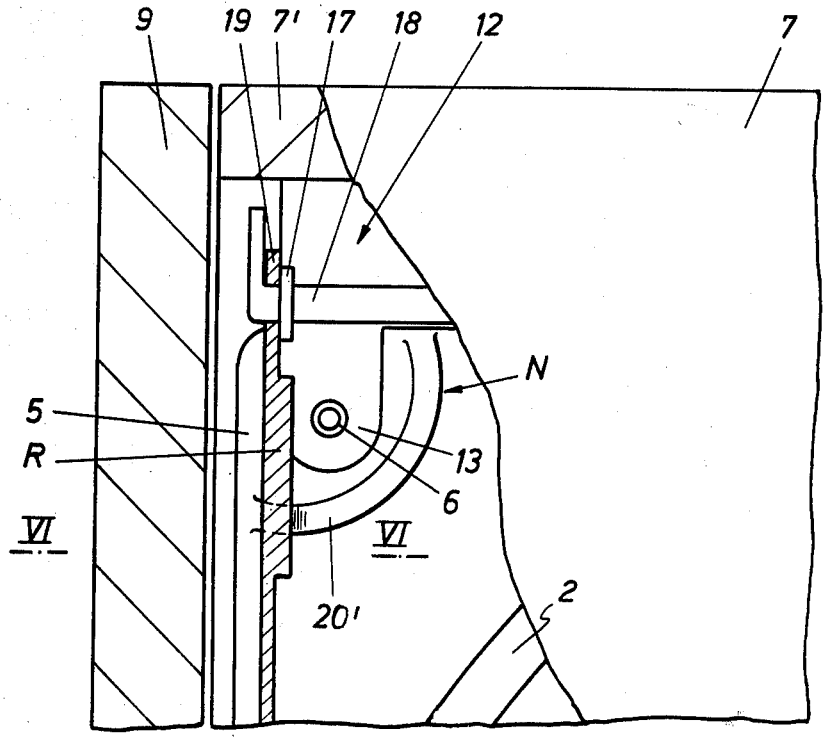
FIG. 5 shows a section corresponding to FIG. 3, with the door closed.
Figure 2:
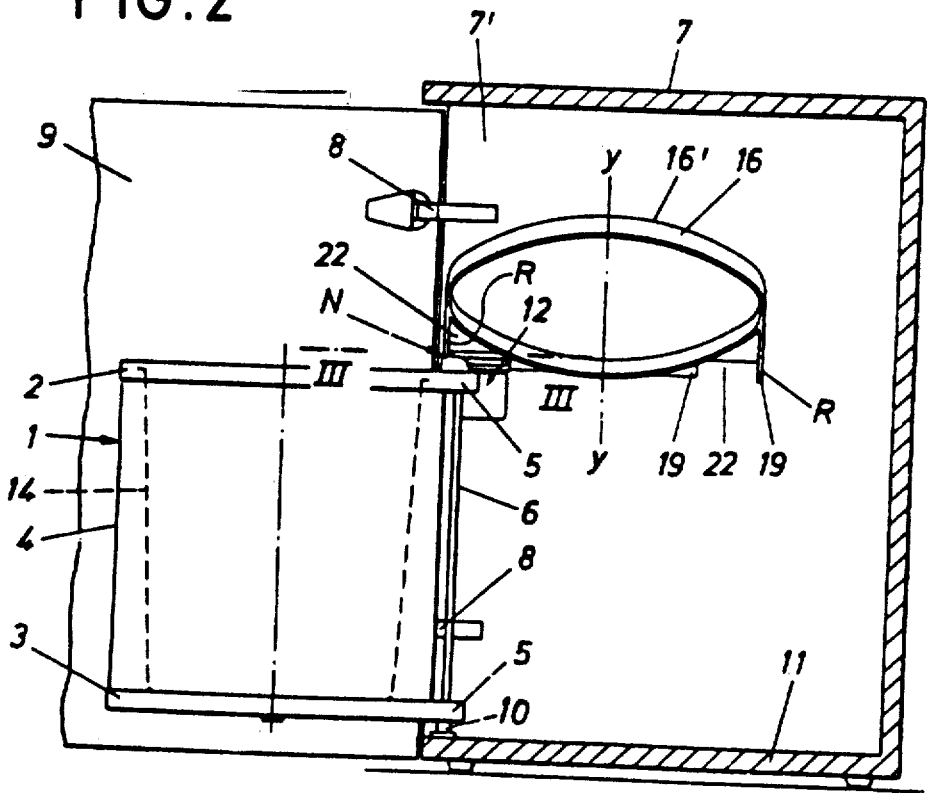

The edge strip R can, as is apparent from FIGS. 3, 5 and 6, be backed with a reinforcing strip. By molding formation of the hinged lid 16, this rigidifying strip is formed integrally in one piece with it.

With the hinged lid 16 closed, the projecting pivot cam N goes into the cavity 22 between the actual, circularly shaped, lid edge 16' and the edge strip R, which edge strip R is to be run under by the pivot cam N and which edge strip R continues in the direction of the hinge pin of the hinged lid. In this way, a free space which is to be left in any case for reasons of conservation of material is used in a space-saving manner and significantly to form the control means.

The hinge pin 18 of the hinged lid, which hinge pin is designed as being additionally removable, is provided with a handle 18'.

We claim:

1. In a waste bin for installation in a cabinet equipped with a hinged door which is able to be swung open, the waste bin having a pivot pin extending vertically, laterally to the surface of the bin, the pivot pin being mounted on holding brackets at a housing of the cabinet, coupling means for connection of the waste bin with the door for outward pivoting of the waste bin upon opening of the hinged door, and a hinged lid for closing the waste bin and opening automatically upon opening of the hinged door, the improvement comprising a hinge pin, said hinged lid is pivotally mounted about said hinge pin, said hinged lid has an edge, a pivot cam means is disposed immediately adjacent said hinge pin, said housing has an interior wall portion of the cabinet, said hinge pin being mounted on said interior wall portion and extends parallel to said interior wall portion, said pivot cam means is adjacent said edge of said lid and upon outward pivoting of the waste bin for running under the edge of the lid lifting the latter pivotally about said hinge pin.

2. The waste bin according to claim 1, further comprising a waste bin edge defining an opening of the waste bin, said edge of said hinged lid comprises an edge strip of said hinged lid, said edge strip overlaps the waste bin edge and extends into the range of the said hinge pin, said pivot cam means for moving out of a position thereof behind said edge strip over into a position under said edge strip during opening of the door.

3. The waste bin according to claim 1, wherein said hinge pin is mounted on one of said holding brackets on said interior wall portion of said housing, and said pivot pin for said waste bin is mounted on said holding brackets perpendicularly to said hinge pin.

4. The waste bin according to the claim 1, wherein said one holding bracket, said pivot cam means and said hinged lid are formed symmetrically.

5. The waste bin according to the claim 1, further comprising an arm projects from the surface of the waste bin, said pivot cam means comprises an upwardly projecting curved rib mounted on an upper side of said arm.

6. The waste bin according to claim 5, wherein said rib forms a control surface operatively engaging said edge of said lid, said control surface slopes downwardly towards said pivot pin of the waste bin.

7. The waste bin according to claim 5, wherein the pivot pin pivotally extends into said arm.

8. The waste bin according to claim 1, wherein said pivot cam means is separate from and unconnected with said hinge pin.

* * * * *

UNITED STATES PATENT AND TRADEMARK OFFICE

CERTIFICATE OF CORRECTION

PATENT NO. : 4,304,448

DATED : December 8, 1981

INVENTOR(S) : Josef Neuhaus, et al

It is certified that error appears in the above—identified patent and that said Letters Patent is hereby corrected as shown below:

The Title page showing the illustrative drawing should appear as per the attached sheet.

Signed and Sealed this

*Seventh* Day of *September 1982*

[SEAL]

*Attest:*

GERALD J. MOSSINGHOFF

*Attesting Officer*

*Commissioner of Patents and Trademarks*

United States Patent [19]

Neuhaus et al.

[11] 4,304,448

[45] Dec. 8, 1981

[54] WASTE BIN

[75] Inventors: Josef Neuhaus; Heinz Langesberg, both of Arnsberg, Fed. Rep. of Germany

[73] Assignee: M. Westermann & Co. GmbH, Arnsberg, Fed. Rep. of Germany

[21] Appl. No.: 140,050

[22] Filed: Apr. 14, 1980

[30] Foreign Application Priority Data

Apr. 21, 1979 [DE] Fed. Rep. of Germany ..... 2916183

[51] Int. Cl.[3] ..... A47B 77/18; B65B 67/04; B65D 43/16

[52] U.S. Cl. ..... 312/273; 312/211; 248/134; 248/147

[58] Field of Search ..... 312/273, 211; 248/95, 248/134, 147

[56] References Cited

U.S. PATENT DOCUMENTS

| | | | |
|---|---|---|---|
| 512,261 | 1/1894 | Nailor | 248/134 |
| 957,237 | 5/1910 | Moorman | 248/134 |
| 1,799,764 | 4/1931 | Schellberg | 248/134 |
| 2,444,125 | 6/1948 | Wheeler | 248/134 |
| 2,621,099 | 12/1952 | Lehman | 312/273 |
| 2,701,112 | 2/1955 | Powers | 248/134 |
| 2,808,173 | 10/1957 | Patnode | 248/147 |
| 3,788,720 | 1/1974 | Schneider | 312/211 |

FOREIGN PATENT DOCUMENTS

| | | | |
|---|---|---|---|
| 1024010 | 5/1956 | Fed. Rep. of Germany | 312/211 |
| 2637074 | 3/1977 | Fed. Rep. of Germany | 312/211 |

OTHER PUBLICATIONS

7319091 West German Gebrauchsmuster.
7035724 West German Gebrauchsmuster.
6906111 West German Gebrauchsmuster.

*Primary Examiner*—Victor N. Sakran
*Attorney, Agent, or Firm*—Martin A. Farber

[57] ABSTRACT

A waste bin for incorporation in a cabinet with a hinged door having a pivot pin extending vertically, laterally of the bin, the pivot pin being operatively mounted on brackets on the other side of the cabinet. A lid is hinged on a hinge pin operatively mounted on the side of the cabinet and opens automatically upon opening of the door, and is pivoted into its open position upon outward pivoting of the bin on the pivot pin when the door is opened, by means of a cam which engages the edge of the lid.

8 Claims, 7 Drawing Figures

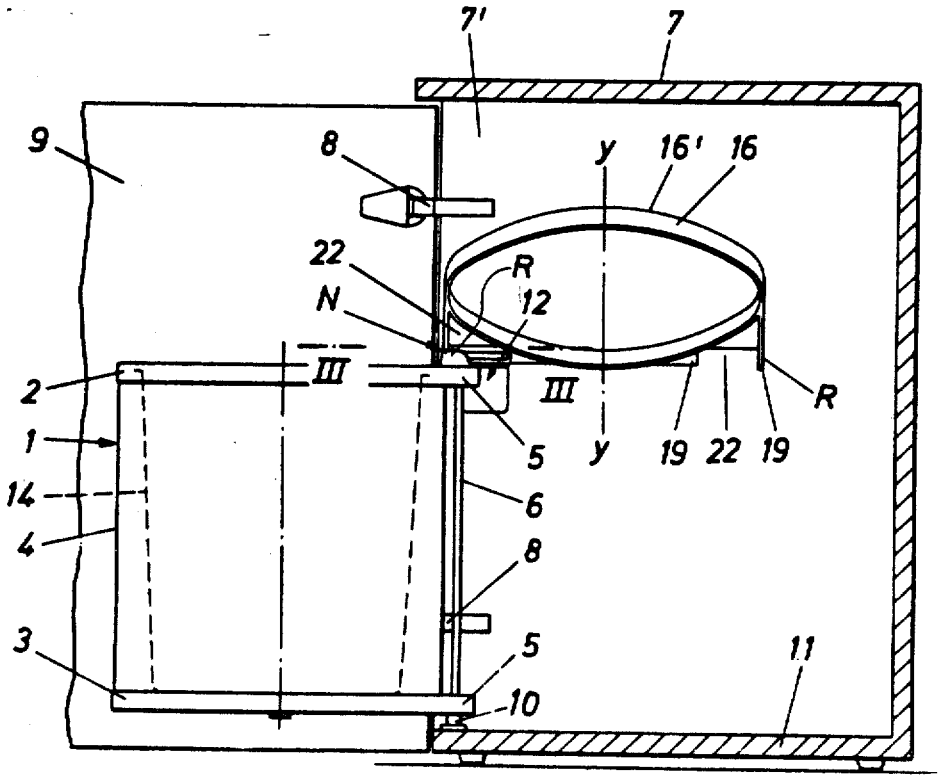

UNITED STATES PATENT AND TRADEMARK OFFICE

CERTIFICATE OF CORRECTION

PATENT NO. : 4,304,448

DATED : December 8, 1981

INVENTOR(S) : Josef Neuhaus et al.

It is certified that error appears in the above—identified patent and that said Letters Patent is hereby corrected as shown below:

The title page showing the illustrative Figure should appear as per attached sheet.

Figure 2 should appear as per attached sheet.

Signed and Sealed this

*Eighth* Day of *March 1983*

[SEAL]

*Attest:*

GERALD J. MOSSINGHOFF

*Attesting Officer*

*Commissioner of Patents and Trademarks*

United States Patent [19]

Neuhaus et al.

[11] 4,304,448

[45] Dec. 8, 1981

[54] WASTE BIN

[75] Inventors: Josef Neuhaus; Heinz Langesberg, both of Arnsberg, Fed. Rep. of Germany

[73] Assignee: M. Westermann & Co. GmbH, Arnsberg, Fed. Rep. of Germany

[21] Appl. No.: 140,050

[22] Filed: Apr. 14, 1980

[30] Foreign Application Priority Data

Apr. 21, 1979 [DE] Fed. Rep. of Germany ..... 2916183

[51] Int. Cl.[3] ..... A47B 77/18; B65B 67/04; B65D 43/16

[52] U.S. Cl. ..... 312/273; 312/211; 248/134; 248/147

[58] Field of Search ..... 312/273, 211; 248/95, 248/134, 147

[56] References Cited

U.S. PATENT DOCUMENTS

| | | | |
|---|---|---|---|
| 512,261 | 1/1894 | Nailor | 248/134 |
| 957,237 | 5/1910 | Moorman | 248/134 |
| 1,799,764 | 4/1931 | Schellberg | 248/134 |
| 2,444,125 | 6/1948 | Wheeler | 248/134 |
| 2,621,099 | 12/1952 | Lehman | 312/273 |
| 2,701,112 | 2/1955 | Powers | 248/134 |
| 2,808,173 | 10/1957 | Patnode | 248/147 |
| 3,788,720 | 1/1974 | Schneider | 312/211 |

FOREIGN PATENT DOCUMENTS

| | | | |
|---|---|---|---|
| 1024010 | 5/1956 | Fed. Rep. of Germany | 312/211 |
| 2637074 | 3/1977 | Fed. Rep. of Germany | 312/211 |

OTHER PUBLICATIONS

7319091 West German Gebrauchsmuster.
7035724 West German Gebrauchsmuster.
6906111 West German Gebrauchsmuster.

*Primary Examiner*—Victor N. Sakran
*Attorney, Agent, or Firm*—Martin A. Farber

[57] ABSTRACT

A waste bin for incorporation in a cabinet with a hinged door having a pivot pin extending vertically, laterally of the bin, the pivot pin being operatively mounted on brackets on the other side of the cabinet. A lid is hinged on a hinge pin operatively mounted on the side of the cabinet and opens automatically upon opening of the door, and is pivoted into its open position upon outward pivoting of the bin on the pivot pin when the door is opened, by means of a cam which engages the edge of the lid.

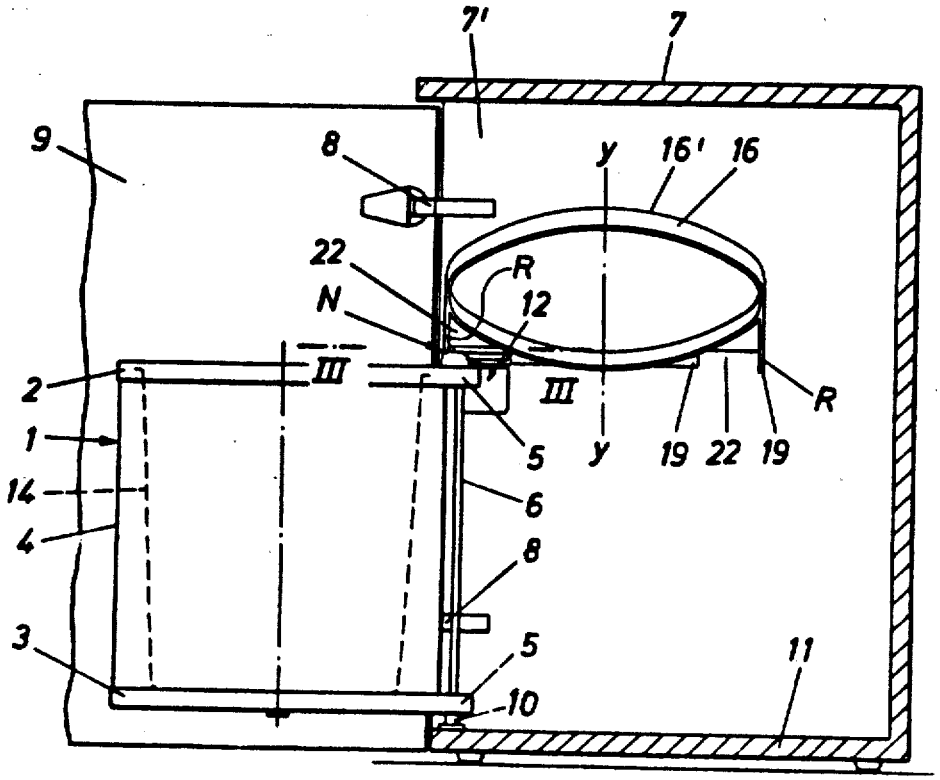

8 Claims, 7 Drawing Figures